US006746606B2

(12) United States Patent
Pfeil et al.

(10) Patent No.: US 6,746,606 B2
(45) Date of Patent: Jun. 8, 2004

(54) METHOD AND SYSTEM FOR MATCHING FLOW RATE

(75) Inventors: Michael C. Pfeil, Dayton, OH (US); Gary C. Fulks, Spring Valley, OH (US)

(73) Assignee: Delphi Technologies, Inc., Troy, MI (US)

( * ) Notice: Subject to any disclaimer, the term of this patent is extended or adjusted under 35 U.S.C. 154(b) by 156 days.

(21) Appl. No.: 10/045,700

(22) Filed: Jan. 11, 2002

(65) Prior Publication Data

US 2003/0132161 A1 Jul. 17, 2003

(51) Int. Cl.[7] ..... B01D 61/32; F04B 49/20

(52) U.S. Cl. ..... 210/646; 137/10; 137/565.11; 210/137; 210/321.65; 210/929; 417/43; 604/67

(58) Field of Search ..... 210/85, 87, 96.2, 210/97, 103, 137, 321.71, 646, 739, 929; 73/1.01, 1.02, 1.16, 1.35, 861, 196, 861.42; 137/2, 8, 98, 100, 101.19, 565.11; 604/4.01, 5.01, 65, 67

(56) References Cited

U.S. PATENT DOCUMENTS 4,021,341 A * 5/1977 Cosentino et al. ..... 210/87
4,132,644 A * 1/1979 Kolberg ..... 210/85
4,293,409 A 10/1981 Riede et al.
4,334,988 A 6/1982 Milligan
4,370,983 A * 2/1983 Lichtenstein ..... 600/301
5,111,683 A * 5/1992 Fond ..... 73/1.27
5,455,781 A * 10/1995 Reynal et al. ..... 702/82
5,975,353 A * 11/1999 Finlayson ..... 222/26
6,280,632 B1 * 8/2001 Polaschegg ..... 210/739
6,607,669 B2 * 8/2003 Schick ..... 210/637
6,610,027 B1 * 8/2003 El Hatu ..... 604/65

FOREIGN PATENT DOCUMENTS

GB 1 487 242 9/1977

* cited by examiner

*Primary Examiner*—Joseph Drodge
(74) *Attorney, Agent, or Firm*—Michael D. Smith

(57) ABSTRACT

A flow rate of unconnected first and second fluid flows is matched, such as, but not limited to, matching the flow rate of the replacement water stream with the waste water stream in kidney dialysis. The first and second flow paths are interconnected so substantially the same flow from a positive displacement pump in the first path encounters a flow-rate transducer in the second path. Transducer readings are taken for various values of the controllable pump speed of the pump. Then, the first and second flow paths are disconnected, a transducer reading is taken, and the flow rate of the fluid flow in the first flow path is controlled by controlling the pump speed using the value of the pump speed from the previous interconnected paths which corresponds to the value of the transducer reading from the previous interconnected paths which matches the transducer reading for the disconnected paths.

21 Claims, 3 Drawing Sheets

METHOD AND SYSTEM FOR MATCHING FLOW RATE

TECHNICAL FIELD

The present invention relates generally to fluid flow, and more particularly to a method and to a system for matching the fluid flow rate in two fluidly-unconnected flow paths.

BACKGROUND OF THE INVENTION

Certain procedures require the matching of two fluid flow rates. Some conventional flow rate matching systems use a finely calibrated positive displacement pump (e.g., a peristaltic pump) in the first flow path and use a finely calibrated flow rate transducer in the second flow path. To match the flow rates, the pump speed of the finely calibrated (i.e., calibrated pump flow rate versus pump speed) positive displacement pump is controlled by using a pump speed corresponding to the calibrated pump flow rate which matches the flow rate reading of the finely calibrated flow rate transducer, as is understood by those skilled in the art.

What is needed is an improved method for matching first and second flow rates and an improved fluid flow-rate matching system useful, for example, in performing kidney dialysis.

SUMMARY OF THE INVENTION

A first method of the invention is for matching the flow rate of first and second fluid flows in respective, fluidly-unconnected first and second flow paths, wherein the first flow path includes a first flow source which includes a positive displacement pump having a controllable pump speed, and wherein the second flow path includes a second flow source and a flow-rate transducer. The first method includes steps a) through g). Step a) includes shutting off the second flow source. Step b) includes fluidly interconnecting the first and second flow paths creating an interconnected flow path which allows substantially the same flow from the positive displacement pump of the first flow source to encounter the flow-rate transducer. Step c) includes, after steps a) and b), obtaining readings from the flow-rate transducer for various values of the pump speed. Step d) includes, after step c), disconnecting the fluid interconnection between the first and second flow paths. Step e) includes turning on the second flow source. Step f) includes, after steps d) and e), obtaining a reading from the flow-rate transducer. Step g) includes controlling the flow rate of the first fluid flow to match the flow rate of the second fluid flow by controlling the pump speed using the value of the pump speed in step c) which corresponds to the reading of the flow-rate transducer in step c) which substantially matches the reading of the flow-rate transducer in step i.

In a first embodiment of the invention, a fluid flow-rate matching system includes a first fluid flow path, a second fluid flow path, a fluid interconnection path, and data. The first fluid flow path has in series a first flow source and a first valve, wherein the first flow source includes a positive displacement pump having a controllable pump speed. The second fluid flow path has in series a second valve and a flow-rate transducer. The fluid interconnection path has in series a first end, an interconnection valve, and a second end. The first end is in fluid communication with the first fluid flow path between the first valve and the positive displacement pump. The second end is in fluid communication with the second fluid flow path between the second valve and the flow-rate transducer. The data represent various values of the pump speed of the positive displacement pump and represent readings of the flow-rate transducer corresponding to the values of the pump speed taken with the first valve fully shut, the interconnection valve fully open, and the second valve fully shut. The pump speed is controlled from the reading of the flow-rate transducer taken with the first valve fully open, the interconnection valve fully shut, and the second valve fully open and from the data.

Several benefits and advantages are derived from one or more of the method and the embodiment of the invention. The matching of one fluid flow rate to another fluid flow rate, such as matching the flow rate of the replacement water stream to the flow rate of the waste water stream in kidney dialysis, is accomplished without having to use a calibrated positive displacement pump and a calibrated flow-rate transducer. Using an uncalibrated positive displacement pump and an uncalibrated flow-rate transducer reduces costs.

DESCRIPTION OF THE PREFERRED EMBODIMENT

Figure 1:
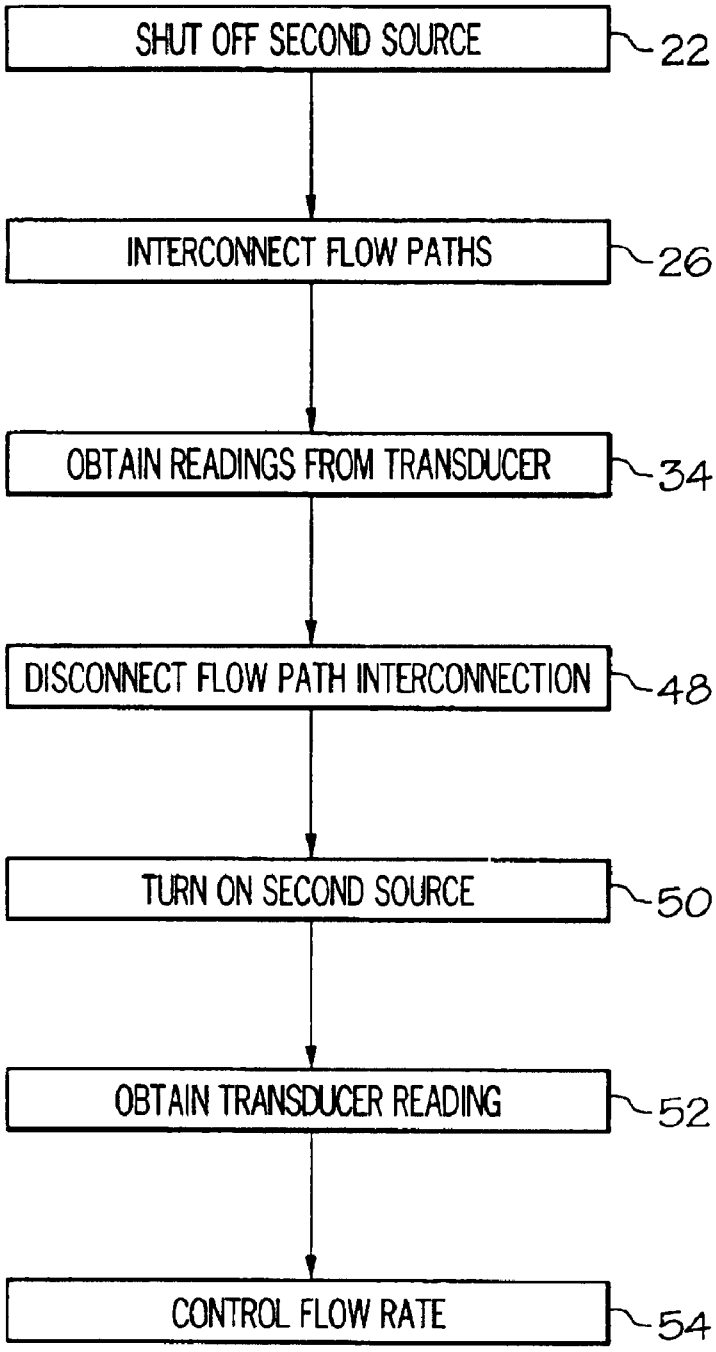
FIG. 1 is a flow chart of a first method for matching first and second fluid flow rates in respective, fluidly-unconnected first and second flow paths.
Figure 2:
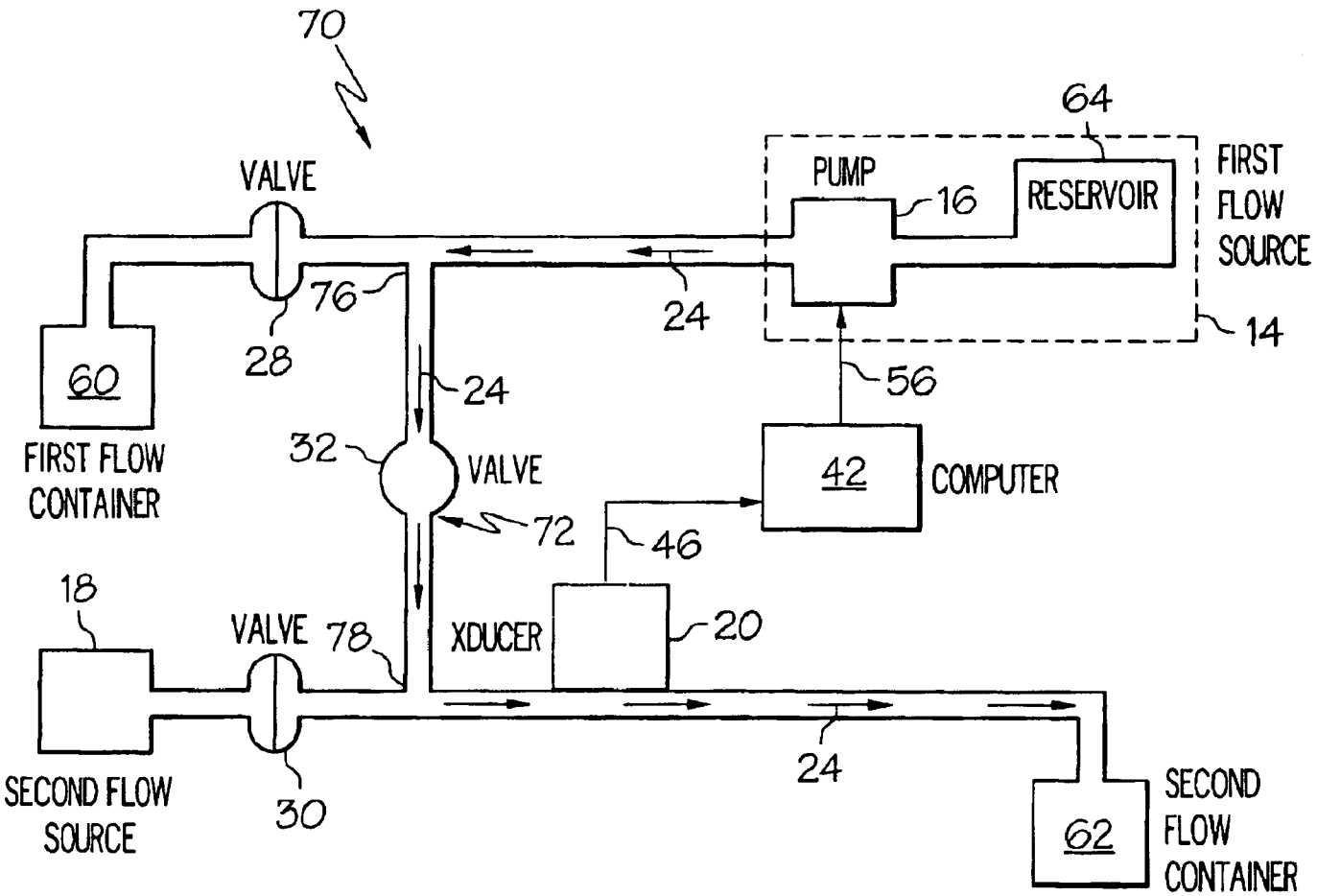
FIG. 2 is a schematic diagram of a first embodiment of apparatus for carrying out the first method of FIG. 1 shown in an analysis mode wherein the flow paths are interconnected to obtain transducer readings for the same flow from the positive displacement pump for various pump speeds.
Figure 3:
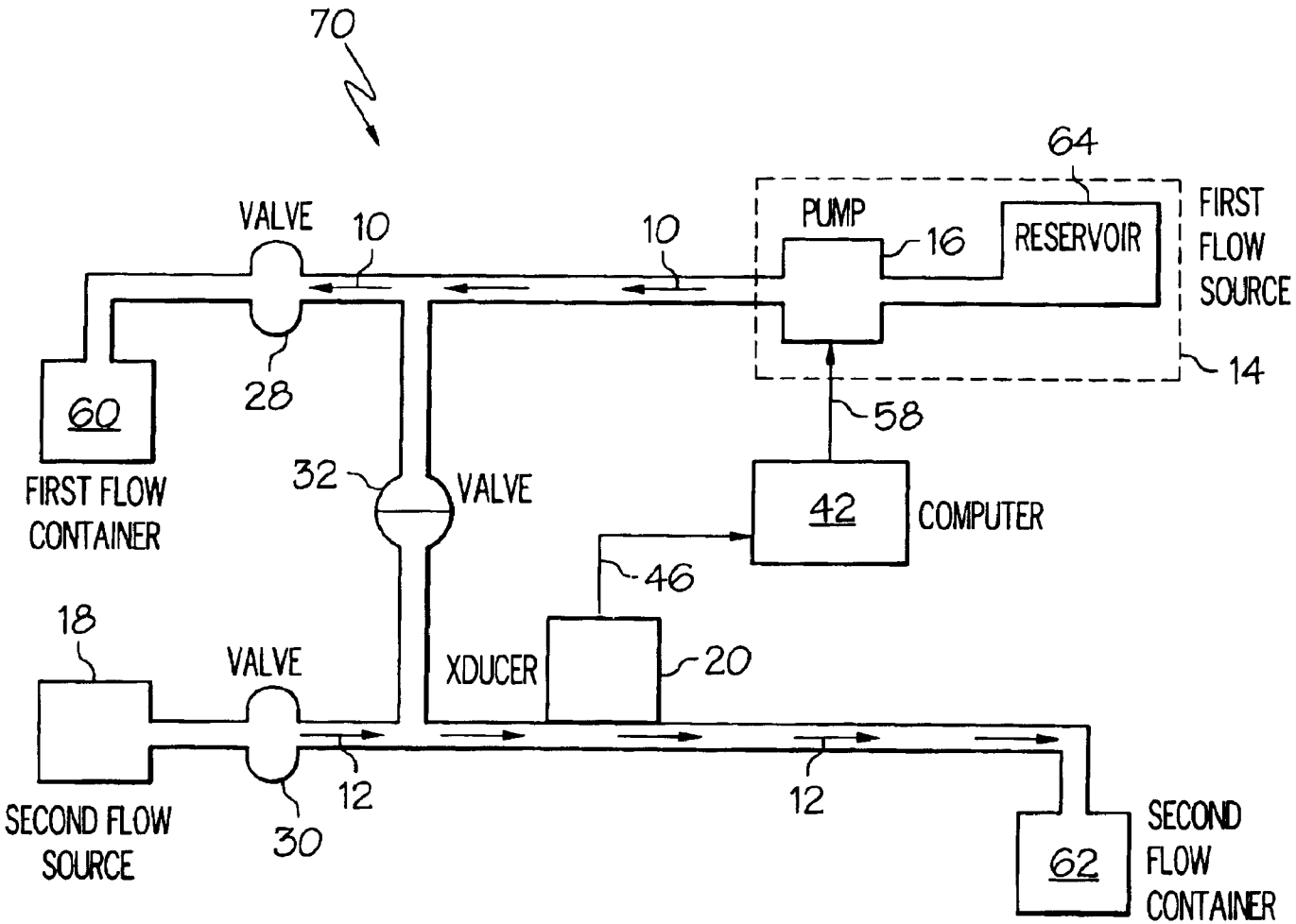
FIG. 3 is a view as in FIG. 2 but with the apparatus shown in a control mode wherein the flow paths are unconnected for matching the first and second flow rates using the transducer reading and using the previous pump speed values and corresponding transducer readings from the analysis mode of FIG. 2.

Referring now to the drawings, wherein like numerals represent like elements throughout, FIG. 1 shows a first method of the invention, and FIGS. 2 and 3 show a first embodiment of apparatus for carrying out the first method. The first method is for matching the flow rate of the first and second fluid flows in respective, fluidly-unconnected first and second flow paths 10 and 12 (shown by flow arrows in FIG. 3 and also called fluid flow paths), wherein the first flow path 10 includes a first flow source 14 which includes a positive displacement pump 16, and wherein the second flow path 12 includes a second flow source 18 and a flow-rate transducer 20. The first method includes steps a) through g).

Step a) is labeled as "Shut Off Second Source" in block 22 of FIG. 1. Step a) includes shutting off the second flow source 18. In one implementation of step a), the second flow source is powered down. In another implementation of step a), a closed valve is used to isolate the second flow source.

Step b) is labeled as "Interconnect Flow Paths" in block 26 of FIG. 1. Step b) includes fluidly interconnecting the first and second flow paths creating an interconnected flow path 24 (shown by flow arrows in FIG. 2) which allows substantially the same flow from the positive displacement pump 16 of the first flow source 14 to encounter the flow-rate transducer 20. In an overlapping implementation of steps a) and b), as shown in FIG. 2, the first and second valves 28 and 30 are fully shut and the interconnection valve 32 is fully open.

Step c) is labeled as "Obtain Readings From Transducer" in block 34 of FIG. 1. Step c) includes, after steps a) and b), obtaining readings from the flow-rate transducer 20 for various values of the pump speed. In one example, the value of the pump speed is the value of the pump speed setting of the positive displacement pump 16, as can be appreciated by the artisan. In one implementation of step c), the pump speed of the positive displacement pump 16 in FIG. 2 is incrementally changed, by incrementally changing the pump speed setting, to create the various values of the pump speed, and the flow is allowed to reach steady state before the transducer readings are taken. Other implementations of step c) are left to the artisan. In one application of the first method, step c) includes storing the various values of the pump speed of the positive displacement pump 16 and the corresponding transducer readings of the flow-rate transducer 20 in a map file in a computer 42 with the computer generating the various values of the pump speed and with the flow-rate transducer 20 sending its reading to the computer through signal 46. In one variation, the map file is a two column file, wherein the first column is the various values of the pump speed, wherein the second column is the readings of the flow-rate transducer 20, and wherein the flow-rate transducer reading in a row is the corresponding transducer reading which corresponds to the value of the pump speed in the same row of the map file. In one example, the computer 42 incrementally changes the pump speed of the positive displacement pump 16 through signal 56. Other implementations of step c) are left to the artisan.

Step d) is labeled as "Disconnect Flow Path Interconnection" in block 48 of FIG. 1. Step d) includes, after step c), disconnecting the fluid interconnection between the first and second flow paths.

Step e) is labeled as "Turn On Second Source" in block 50 of FIG. 1. Step e) includes turning on the second flow source 18. In one implementation of step e), the second flow source is powered up. In another implementation of step e), an open valve is used to provide fluid access to the second flow source. In an overlapping implementation of steps d) and e), as shown in FIG. 3, the first and second valves 28 and 30 are fully open and the interconnection valve 32 is fully shut.

Step f) is labeled as "Obtain Transducer Reading" in block 52 of FIG. 1. Step f) includes, after steps d) and e), obtaining a reading from the flow-rate transducer 20.

Step g) is labeled as "Control Flow Rate" in block 54 of FIG. 1. Step g) includes controlling the flow rate of the first fluid flow to match the flow rate of the second fluid flow by controlling the pump speed using the value of the pump speed in step c) which corresponds to the reading of the flow rate transducer 20 in step c) which substantially matches the reading of the flow-rate transducer 20 in step f). It is noted that step c) values and readings are understood to include interpolated and/or extrapolated values and readings. As one illustration of one implementation of step g), assume one row of the map file, of the previously described application of step c), has "10" as the value of the pump speed and has "25" as the value of the flow-rate transducer reading. Assume that the step f) reading of the flow rate transducer 20 is "25". The computer 42 looks in the map file for a "25" reading of the flow rate transducer to obtain the value of "10" from the same row of the map file for the pump speed. In one variation, the computer 42 sends a value of "10" as the pump speed setting to the positive displacement pump 16 through signal 58 to match the flow rate of the first fluid flow to the flow rate of the second fluid flow, as can be appreciated by those skilled in the art. Other implementations of step g) are left to the artisan.

In one example of the first method, the flow-rate transducer 20 is an uncalibrated flow-rate transducer. It is noted that a flow-rate transducer measures the flow rate of a fluid flow if it directly or indirectly measures the flow rate. In one variation, the flow-rate transducer 20 is an uncalibrated differential pressure transducer. Other examples of flow-rate transducers are left to the artisan. In the same or another example, the positive displacement pump 16 is an uncalibrated positive displacement pump. In one variation, the positive displacement pump 16 is an uncalibrated peristaltic pump. Other examples of positive displacement pumps are left to the artisan. In one application of the first method, the first flow path 10 is a replacement water flow path of a kidney dialysis machine, and the second flow path 12 is a waste water flow path of the kidney dialysis machine. In this application, the first flow container 60 represents the joining of the first fluid flow (here the replacement water stream) and the thickened blood stream (not shown) for return to the patient (not shown), and the second flow container 62 represents a waste container. In the same or another application, the first flow source 14 also includes a reservoir 64, and the positive displacement pump 16 draws fluid from the reservoir 64. Other applications are left to the artisan.

In a first embodiment of the invention, a fluid flow-rate matching system 70 includes a first fluid flow path 10, a second fluid flow path 12, a fluid interconnection path 72, and data. The first fluid flow path 10 has in series a first flow source 14 and a first valve 28, wherein the first flow source 14 includes a positive displacement pump 16 having a controllable pump speed. The second fluid flow path 12 has in series a second valve 30 and a flow-rate transducer 20. The fluid interconnection path 72 has in series a first end 76, an interconnection valve 32, and a second end 78. The first end 76 is in fluid communication with the first fluid flow path 10 between the first valve 28 and the positive displacement pump 16, and the second end 78 is in fluid communication with the second fluid flow path 12 between the second valve 30 and the flow-rate transducer 20. The data represent various values of the pump speed of the positive displacement pump 16 and represent readings of the flow-rate transducer 20 corresponding to the values of the pump speed taken with the first valve 28 fully shut, the interconnection valve 32 filly open, and the second valve 30 filly shut. The pump speed of the positive displacement pump 16 is controlled from the reading of the flow-rate transducer 20 taken with the first valve 28 fully open, the interconnection valve 32 fully shut, and the second valve 30 filly open and from the data. In one example, the data are stored in a computer 42.

Several benefits and advantages are derived from one or more of the method and the embodiment of the invention. The matching of one fluid flow rate to another fluid flow rate, such as matching the flow rate of the replacement water stream to the flow rate of the waste water stream in kidney dialysis, is accomplished without having to use a calibrated positive displacement pump and a calibrated flow-rate transducer. Using an uncalibrated positive displacement pump and an uncalibrated flow-rate transducer reduces costs.

The foregoing description of a method and an embodiment of the invention has been presented for purposes of illustration. It is not intended to be exhaustive or to limit the invention to the precise form or procedure disclosed, and obviously many modifications and variations are possible in light of the above teaching. It is intended that the scope of the invention be defined by the claims appended hereto.

What is claimed is:

1. A method for matching the flow rate of first and second fluid flows in respective, fluidly-unconnected first and second flow paths, wherein the first flow path includes a first flow source which includes a positive displacement pump having a controllable pump speed, wherein the second flow path includes a second flow source and a flow-rate transducer, and wherein the method comprises the steps of:

a) shutting off the second flow source;

b) fluidly interconnecting the first and second flow paths creating an interconnected flow path which allows substantially the same flow from the positive displacement pump of the first flow source to encounter the flow-rate transducer;

c) after steps a) and b), obtaining readings from the flow-rate transducer for various values of the pump speed;

d) after step c), disconnecting the fluid interconnection between the first and second flow paths;

e) turning on the second flow source;

f) after steps d) and e), obtaining a reading from the flow-rate transducer; and g) controlling the flow rate of the first fluid flow to match the flow rate of the second fluid flow by controlling the pump speed using the value of the pump speed in step c) which corresponds to the reading of the flow-rate transducer in step c) which substantially matches the reading of the flow-rate transducer in step f).

2. The method of claim 1, wherein the flow-rate transducer is an uncalibrated flow-rate transducer.

3. The method of claim 2, wherein the flow-rate transducer is an uncalibrated differential pressure transducer.

4. The method of claim 2, wherein the positive displacement pump is an uncalibrated positive displacement pump.

5. The method of claim 4, wherein the positive displacement pump is an uncalibrated peristaltic pump.

6. The method of claim 4, wherein the flow-rate transducer is an uncalibrated flow-rate transducer.

7. The method of claim 6, wherein the flow-rate transducer is an uncalibrated differential pressure transducer.

8. The method of claim 7, wherein the positive displacement pump is an uncalibrated peristaltic pump.

9. The method of claim 8, wherein the first flow path is a water replacement flow path of a kidney dialysis machine, and wherein the second flow path is a waste water flow path of the kidney dialysis machine.

10. The method of claim 1, wherein the first flow path is a water replacement flow path of a kidney dialysis machine, and wherein the second flow path is a waste water flow path of the kidney dialysis machine.

11. A fluid flow-rate matching system comprising:

a) a first fluid flow path having in series a first flow source and a first valve, wherein the first flow source includes a positive displacement pump having a controllable pump speed;

b) a second fluid flow path having in series a second valve and a flow-rate transducer;

c) a fluid interconnection path having in series a first end, an interconnection valve, and a second end, wherein the first end is in fluid communication with the first fluid flow path between the first valve and the positive displacement pump, and wherein the second end is in fluid communication with the second fluid flow path between the second valve and the flow-rate transducer; and d) a computer operable for obtaining data representing various values of the pump speed of the positive displacement pump and representing readings of the flow-rate transducer corresponding to the values of the pump speed taken with the first valve fully shut, the interconnection valve fully open, and the second valve fully shut, and controlling the pump speed from a reading of the flow-rate transducer taken with the first valve fully open, the interconnection valve fully shut, and the second valve fully open and from the data.

12. The system of claim 11, wherein the flow-rate transducer is an uncalibrated flow-rate transducer.

13. The system of claim 12, wherein the flow-rate transducer is an uncalibrated differential pressure transducer.

14. The system of claim 12, wherein the positive displacement pump is an uncalibrated positive displacement pump.

15. The system of claim 14, wherein the positive displacement pump is an uncalibrated peristaltic pump.

16. The system of claim 14, wherein the flow-rate transducer is an uncalibrated flow-rate transducer.

17. The system of claim 16, wherein the flow-rate transducer is an uncalibrated differential pressure transducer.

18. The system of claim 17, wherein the positive displacement pump is an uncalibrated peristaltic pump.

19. The system of claim 18, wherein the first flow path is a water replacement flow path of a kidney dialysis machine, and wherein the second flow path is a waste water flow path of the kidney dialysis machine.

20. The system of claim 11, wherein the first flow path is a water replacement flow path of a kidney dialysis machine, and wherein the second flow path is a waste water flow path of the kidney dialysis machine.

21. A method for matching the flow rate of first and second fluid flows in respective, fluidly-unconnected first and second flow paths, wherein the first flow path includes a first flow source which includes a positive displacement pump having a controllable pump speed, wherein the second flow path includes a second flow source and a flow-rate transducer, wherein the flow-rate transducer is the only flow-rate transducer of the second flow path, wherein the first flow path is devoid of a flow-rate transducer, and wherein the method comprises the steps of:

a) shutting off the second flow source;

b) fluidly interconnecting the first and second flow paths creating an interconnected flow path which allows substantially the same flow from the positive displacement pump of the first flow source to encounter the flow-rate transducer;

c) after steps a) and b), obtaining readings from the flow-rate transducer for various values of the pump speed; d) after step c), disconnecting the fluid interconnection between the first and second flow paths; e) turning on the second flow source;

f) after steps d) and e), obtaining a reading from the flow-rate transducer; and g) controlling the flow rate of the first fluid flow to match the flow rate of the second fluid flow by controlling the pump speed using the value of the pump speed in step c) which corresponds to the reading of the flow-rate transducer in step c) which substantially matches the reading of the flow-rate transducer in step f).

* * * * *